US009087440B2

(12) United States Patent
Gao et al.

(10) Patent No.: US 9,087,440 B2
(45) Date of Patent: Jul. 21, 2015

(54) DISPENSING DEVICE IN VENDING MACHINE

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Zhi-Yong Gao, Wuhan (CN); Yu-Lin Liu, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 96 days.

(21) Appl. No.: 14/050,599

(22) Filed: Oct. 10, 2013

(65) Prior Publication Data

US 2014/0252022 A1 Sep. 11, 2014

(30) Foreign Application Priority Data

Mar. 11, 2013 (CN) ..... 2013 1 0076161

(51) Int. Cl.
*G07F 11/38* (2006.01)
*G07F 9/10* (2006.01)
*G07F 11/00* (2006.01)

(52) U.S. Cl.
CPC *G07F 11/38* (2013.01); *G07F 9/10* (2013.01); *G07F 11/005* (2013.01)

(58) Field of Classification Search
CPC ..... G07F 11/005; G07F 11/38
USPC ..... 221/123, 124, 130, 131, 133, 151, 152, 221/14, 282, 283, 284, 285, 286, 65
See application file for complete search history.

(56) References Cited

U.S. PATENT DOCUMENTS

| | | | | |
|---|---|---|---|---|
| 3,294,282 | A * | 12/1966 | Brown | 221/12 |
| 4,108,333 | A * | 8/1978 | Falk et al. | 221/13 |
| 4,252,250 | A * | 2/1981 | Toth | 221/13 |
| 4,506,800 | A * | 3/1985 | Wingate | 221/6 |
| 6,357,621 | B1 * | 3/2002 | Guindulain Vidondo | 221/85 |
| 6,719,168 | B2 * | 4/2004 | Nicolini | 221/85 |

* cited by examiner

*Primary Examiner* — Patrick Mackey
(74) *Attorney, Agent, or Firm* — Novak Druce Connolly Bove + Quigg LLP

(57) ABSTRACT

A dispensing device includes a cabinet, a door, a catching assembly, and a driving assembly. The cabinet includes a plurality of product boxes for receiving products. The door is pivotably mounted to the cabinet. The catching assembly includes a catch portion, a shipping portion, and a connecting portion connected between the catch portion and the shipping portion; and the connecting portion defining a goods channel communicating with the catch portion, the shipping portion, and the receiving opening. The connecting portion is scalable in a vertical direction. The catch portion is slidable relative to the cabinet. The driving assembly is capable of driving the catch portion to slide to a selected product box of the plurality of product boxes to catch a corresponding product.

19 Claims, 5 Drawing Sheets

DISPENSING DEVICE IN VENDING MACHINE

BACKGROUND

1. Technical Field

The present disclosure relates to vending machines, and particularly to a dispensing device in the vending machines.

2. Description of Related Art

In many dispensing devices, a dispensing assembly for dispensing products includes a cabinet with a plurality of matrix-arranged product boxes and a catching assembly for catching a product dropped from the matrix-arranged product boxes to an opening for the customer. Generally, the opening is located at a lowest portion of the matrix-arranged product boxes. When the product is dropped down from the matrix-arranged product boxes, the product may be damaged due to a great impact force. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
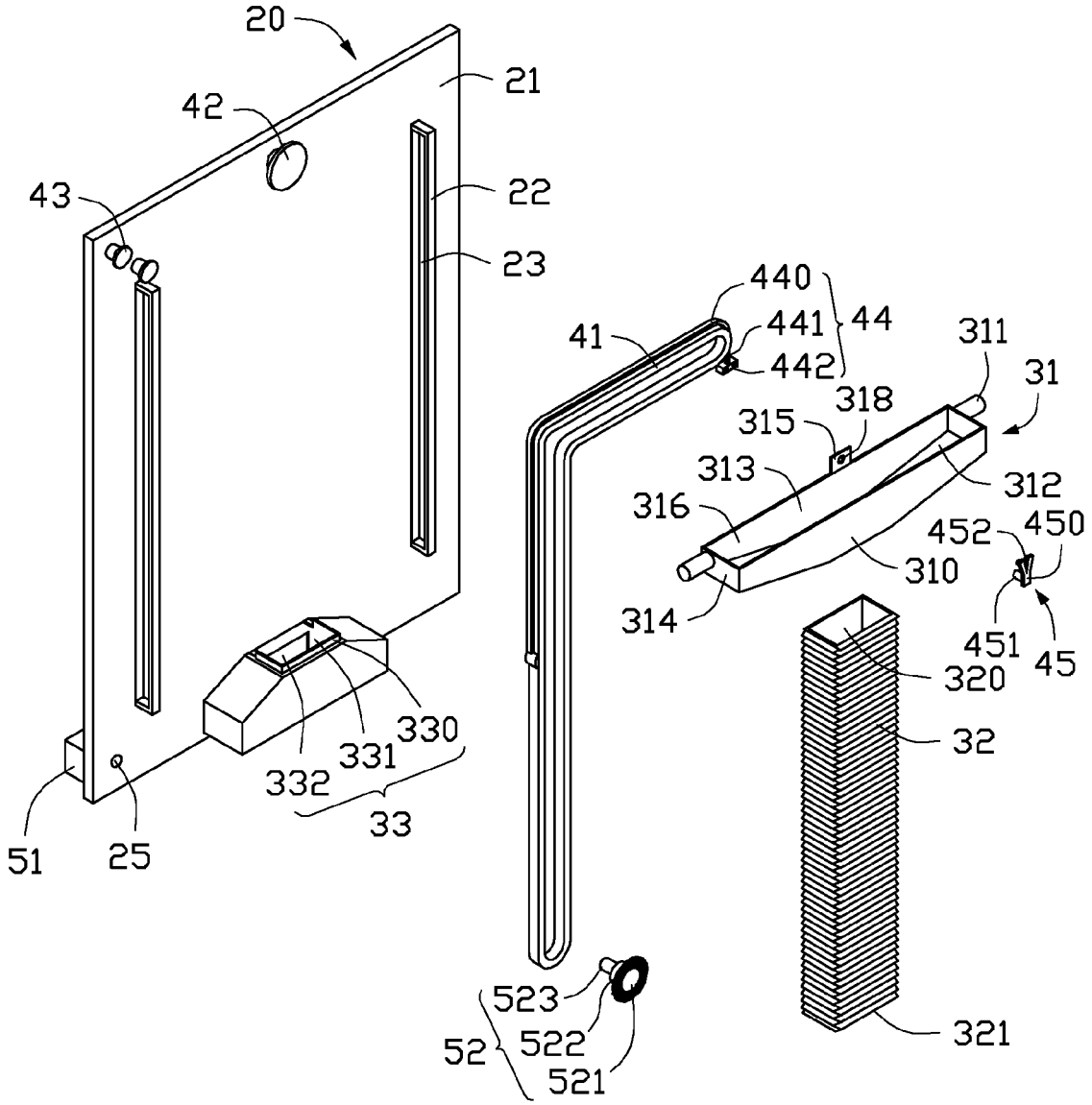
FIG. 1 is an exploded, isometric view of one embodiment of a dispensing device, but without a cabinet.
Figure 2:
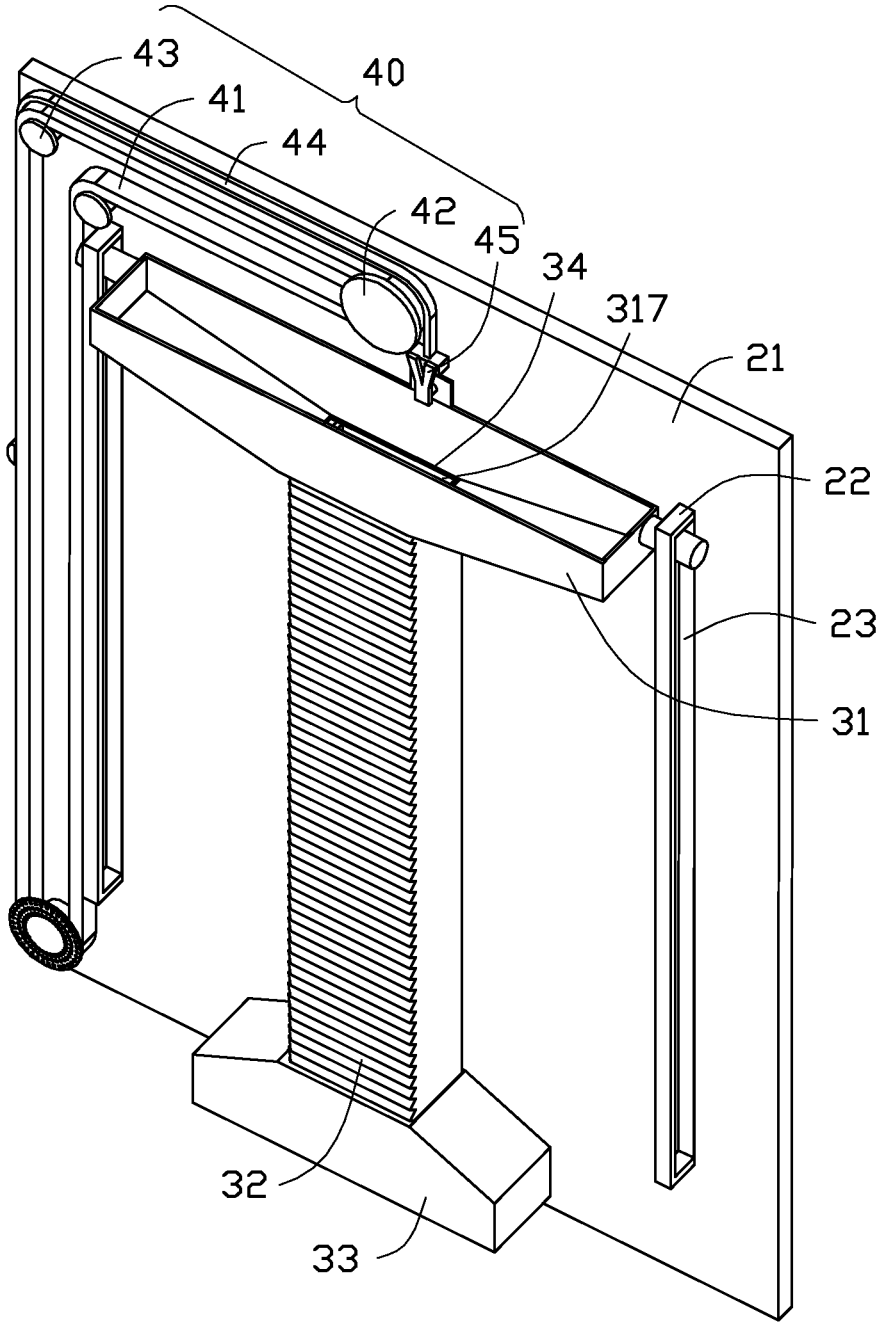
FIG. 2 is an assembled, isometric view of the dispensing device of FIG. 1.
Figure 3:
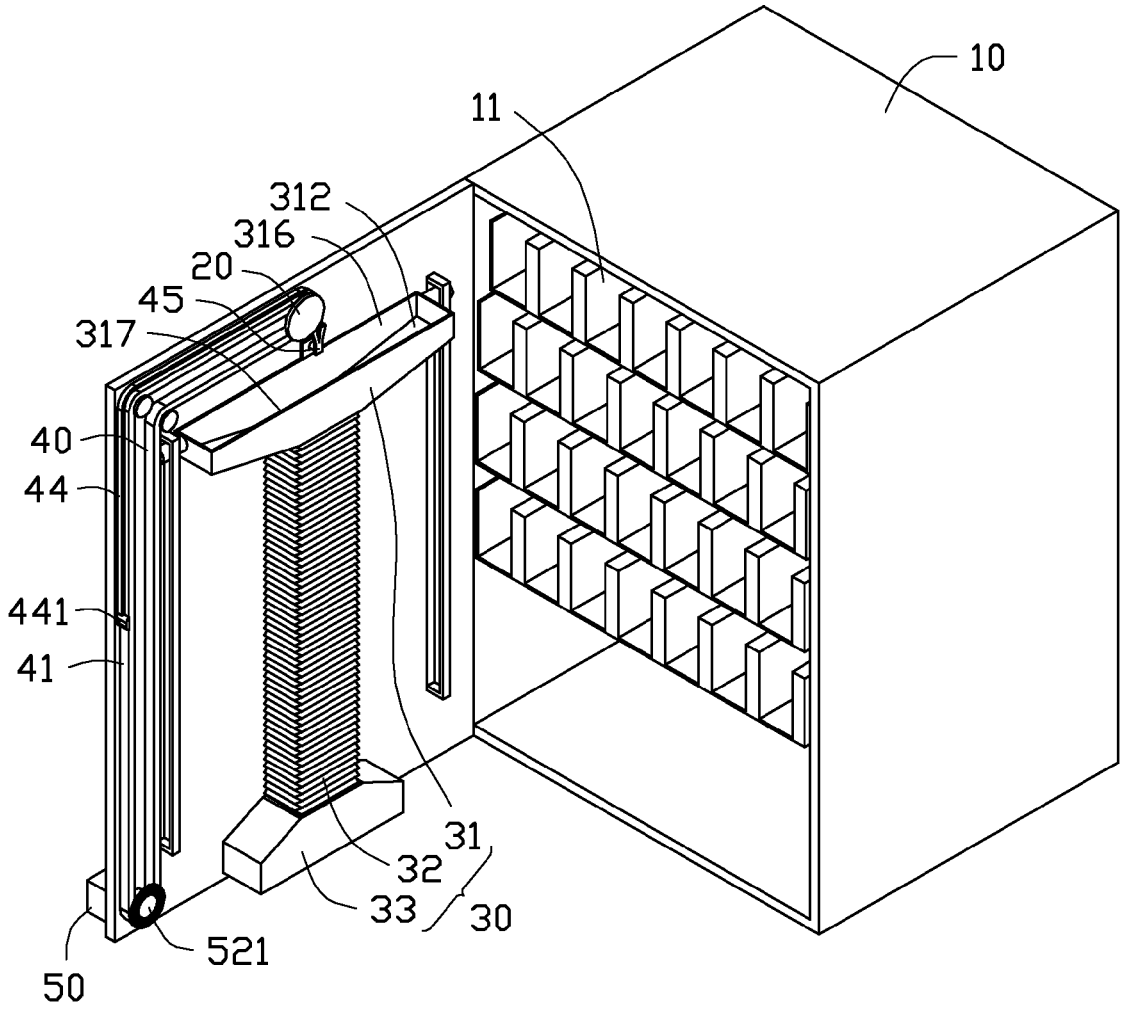
FIG. 3 is an assembled, isometric view of one embodiment of a dispensing device, with a connecting portion in a first position.

FIGS. 1-3 show one embodiment of a dispensing device in a vending machine. The dispensing device includes a cabinet 10, a door 20, a catching assembly 30, a driven assembly 40, and a driving assembly 50.

The cabinet 10 includes a plurality of product boxes 11 for the placing of product.

The door 20 is pivotally mounted on the cabinet 10 and is used to shield the cabinet 10. The door 20 includes a door plate 21 and two mounting ribs 22 located on the door plate 21. Each mounting rib 22 defines a sliding slot 23. The door plate 21 defines a receiving opening 24 (shown in FIG. 4) for catching products and a mounting hole 25.

The catching assembly 30 includes a catch portion 31, a connecting portion 32 communicating with the catch portion 31, and a shipping portion 33 communicating with the connecting portion 32. The catch portion 31 is secured to an inner surface of the door plate 21 and includes a catch box 310 and two sliding posts 311 extending from opposite ends of the catch box 310. The catch box 310 includes two bottom plates 312, two first sidewalls 313, two second sidewalls 314, and an installation piece 315. The two first sidewalls 313 extend from the two bottom plates 312 and are substantially parallel to each other. The two second sidewalls 314 extend from the two bottom plates 312 and are substantially parallel to each other and perpendicular to the two first sidewalls 313. The two bottom plates 312 are slanted relative to each other, and each bottom plate 312 is slanted relative to each first sidewall 313 and each second sidewall 314. The installation piece 315 extends from one of the first sidewalls 313 and defines a first installation hole 318. The catch box 310 defines a catching port 316 and an exit port 317. The connecting portion 32 is folded and scalable in a vertical direction. In one embodiment, the connecting portion 32 is made of plastic. The connecting portion 32 defines a goods channel 320 corresponding to the exit port 317. The shipping portion 33 includes a mounting portion 330 and defines an entrance 331 and a shipment port 332. The entrance 331 corresponds to the goods channel 320. The shipment port 332 corresponds to the receiving opening 24. The shipping portion 33 is secured to the inner surface of the door plate 21.

The driven assembly 40 includes a drive belt 41, a first positioning post 42, two second positioning posts 43, a connecting belt 44, and an installation member 45. The drive belt 41 is annular. The connecting belt 44 includes a belt body 440 and a securing portion 441. The securing portion 441 defines two securing holes 442. A first end of the belt body 440 is secured to the drive belt 41. The securing portion 441 extends from a second end of the belt body 440. The second end of the belt body 440 is free. The installation member 45 includes a first installation post 451 and two second installation posts 452 corresponding to the two second installation holes 442.

The driving assembly 50 includes a driver 51 and a rotating member 52. The driver 51 is secured to an outer surface of the door plate 21. The rotating member 52 includes a head portion 521, a drive portion 522, and an installation portion 523. The drive portion 522 is secured between the head portion 521 and the installation portion 523. A cross-section of the drive portion 522 is smaller than that of the head portion 521 and greater than that of the installation portion 523. In one embodiment, the driver 51 is a motor.

In assembly, the catch portion 31 is secured to a top end of the connecting portion 32 by glue, welding or other methods. The exit port 317 is aligned with the goods channel 320. The shipping portion 33 is secured to a bottom end of the connecting portion 32 by glue, welding or other methods. The entrance 331 is aligned with the goods channel 320. The drive belt 41 surrounds the first positioning post 42 and the two second positioning posts 43. The rotating portion 52 is engaged in the mounting hole 25 through the drive belt 41. The drive belt 41 further surrounds the drive portion 522. The drive belt 41 forms an "L" shaped loop. The sliding post 311 is inserted in the sliding slot 23 to slidably engage the catch portion 31 to the mounting rib 22. The first installation post 451 is engaged in the first installation hole 318, and the second installation post 452 is engaged in the second installation hole 442, to secure the catch portion 31 to the connection belt 44. Thus, the catch assembly 30 is secured to the drive assembly 40.

Figure 4:
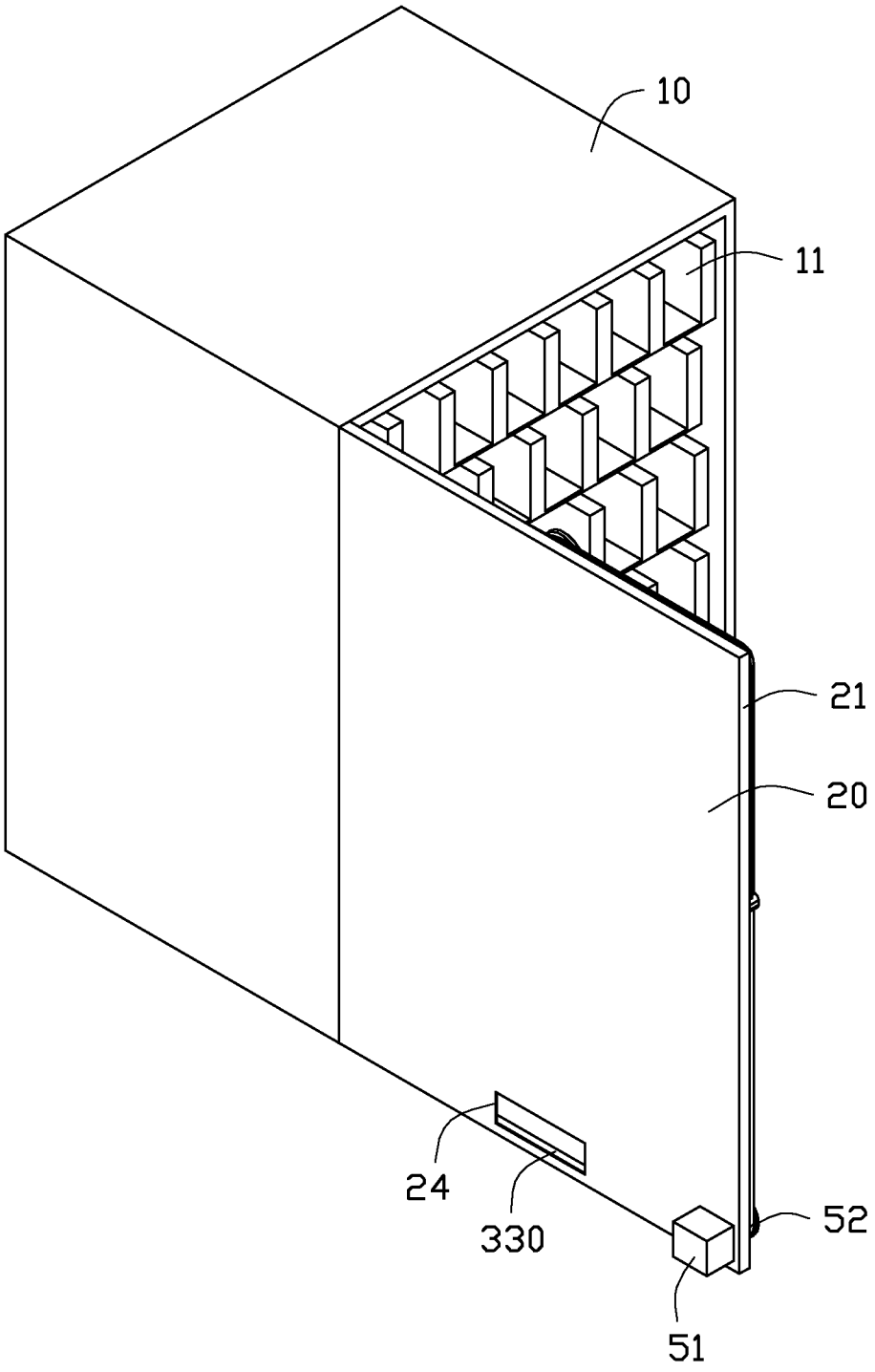
FIG. 4 is similar to FIG. 3, but viewed from a different aspect.
Figure 5:
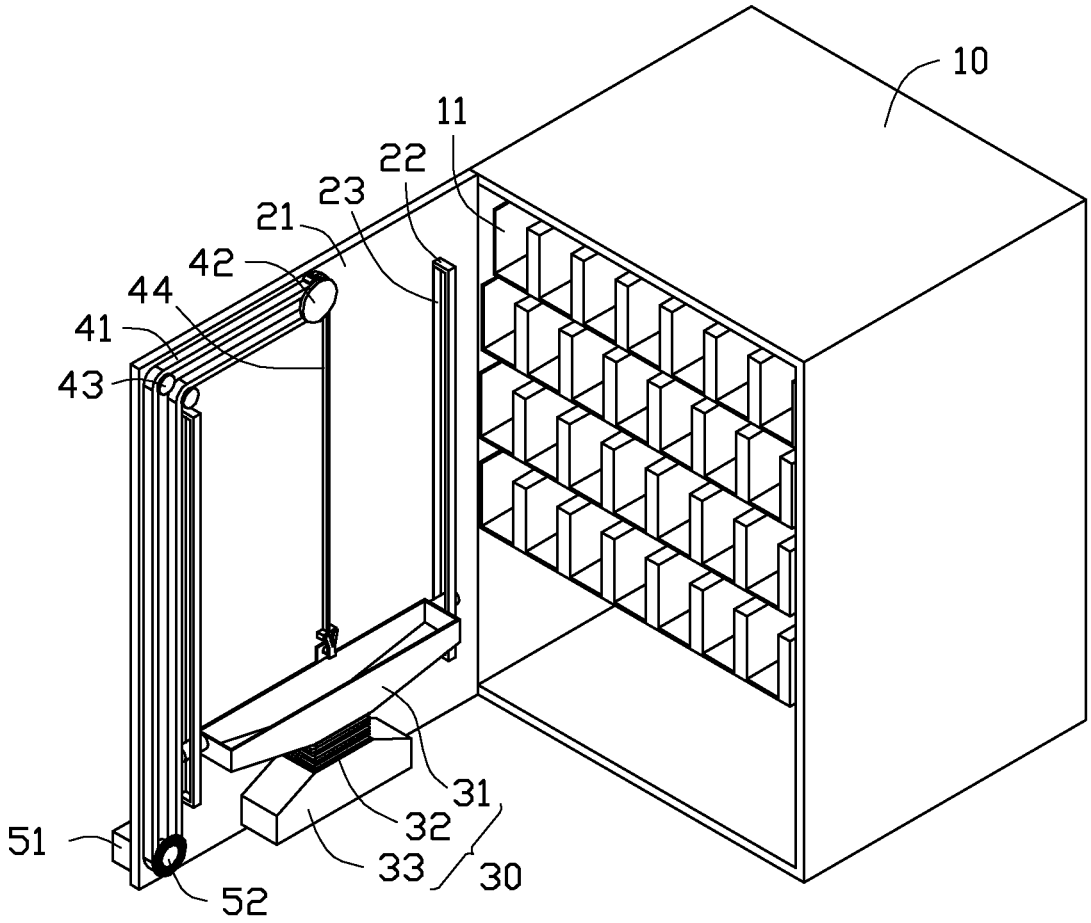
FIG. 5 is another assembled, isometric view of the dispensing device of FIG. 3, with the connecting portion in a second position.

FIGS. 4 and 5 show that when a product is selected, the driver 51 rotates the rotating member 52 which drives the drive belt 41 to move the connecting belt 44. The securing portion 441 moves in a vertical direction to slide the catch portion 31 in the vertical direction. The connecting portion 32 is pushed down or pulled up by the catch portion 31, until the catch portion 31 is aligned to a corresponding product box 11 to receive the product from the product box 11. The product drops down from the bottom plate 312 of the catch portion 31 and drops to the shipment port 332 of the shipping portion 33 via the exit port 317 and the goods channel 320. The product can be taken out through the receiving opening 24. In this process, the catch portion 31 is slidable to the corresponded product box 11 to take product, and the folded goods channel 320 provides a buffer to the product, thereby preventing the product from damage when dropped.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. A dispensing device of a plurality of products, comprising:

a cabinet comprising a plurality of product boxes configured for receiving the plurality of products;

a door pivotably mounted to the cabinet and defining a receiving opening for the plurality of products to pass through;

a catching assembly comprising a catch portion, a shipping portion, and a connecting portion connected between the catch portion and the shipping portion; and a driving assembly;

wherein the connecting portion defining a goods channel communicating with the catch portion, the shipping portion, and the receiving opening; the connecting portion is scalable in a vertical direction; the catch portion is slidable inside the cabinet; and the driving assembly is capable of driving the catch portion to slide to a selected product box of the plurality of product boxes to catch a corresponding product.

2. The dispensing device of claim 1, wherein the catch portion comprises a sliding post, the door comprises a mounting rib with a sliding slot, and the sliding post is slidably engaged in the sliding slot.

3. The dispensing device of claim 2, wherein the catch portion further comprises a catch box with a bottom plate, the bottom plate defines an exit port, and the bottom plate is slanted relative to a horizontal direction to guide the products to the exit port.

4. The dispensing device of claim 1, further comprising a driven assembly and an installation member, wherein the driven assembly is movably connected to the driving assembly, and the installation member secures the catch portion to the driven assembly.

5. The dispensing device of claim 4, wherein the driven assembly comprises a ring belt and a connecting belt; the ring belt is movably connected to the driving assembly and is movable by the driving assembly; and a first end of the connecting belt is secured to the ring belt, and a second end of the connecting belt is secured to the installation member.

6. The dispensing device of claim 5, wherein the connecting belt comprises a securing portion with a securing hole; an installation piece extends from the catch box and defines an installation hole; the installation member comprises a first installation post engaged in the securing hole and a second installation post engaged in the installation hole.

7. The dispensing device of claim 5, wherein the driving assembly comprises a driver and a rotating member secured to the door, and the driver rotates the rotating member to move the ring belt; the driven assembly further comprises a first positioning post and two second positioning posts; the ring belt surrounds the rotating member, the first positioning post, and the two second positioning posts; and the two second positioning posts are located between the first positioning post and the rotating member.

8. The dispensing device of claim 7, wherein the driver is secured to an outer surface of the door, and the driven assembly and the catching assembly is secured to an inner surface of the door.

9. The dispensing device of claim 5, wherein the ring belt is substantially an "L" shaped loop.

10. The dispensing device of claim 5, wherein the door defines a mounting hole, the rotating member comprises a head portion, a drive portion, and an installation portion; the drive portion is secured between the head portion and the installation portion; a cross-section of the drive portion is smaller than that of the head portion and greater than that of the installation portion; the head portion is engaged in the mounting hole through the ring belt, and the ring belt surrounds the drive portion.

11. A dispensing device of a plurality of products, comprising:

a cabinet comprising a plurality of product boxes configured for receiving the plurality of products;

a door pivotably mounted to the cabinet and defining a receiving opening for the plurality of products to pass through;

a catching assembly comprising a catch portion, a shipping portion, and a connecting portion connected between the catch portion and the shipping portion;

a driving assembly;

a driven assembly movably connected to the driving assembly; and an installation member securing the catch portion to the driven assembly;

wherein the connecting portion defining a goods channel communicating with the catch portion, the shipping portion, and the receiving opening; the connecting portion is scalable in a vertical direction; the catch portion is slidable inside the cabinet; and the driving assembly is capable of driving the driven assembly to move and slide the catch portion to a selected product box of the plurality of product boxes to catch a corresponding product through.

12. The dispensing device of claim 11, wherein the catch portion comprises a sliding post, the door comprises a mounting rib with a sliding slot, and the sliding post is slidably engaged in the sliding slot.

13. The dispensing device of claim 12, wherein the catch portion further comprises a catch box with a bottom plate, the bottom plate defines an exit port, and the bottom plate is slanted relative to a horizontal direction to guide the products to the exit port.

14. The dispensing device of claim 11, wherein the driven assembly comprises a ring belt and a connecting belt; the ring belt is movably connected to the driving assembly and is movable by the driving assembly; and a first end of the connecting belt is secured to the ring belt, and a second end of the connecting belt is secured to the installation member.

15. The dispensing device of claim 14, wherein the connecting belt comprises a securing portion with a securing hole; an installation piece extends from the catch box and defines an installation hole; the installation member comprises a first installation post engaged in the securing hole and a second installation post engaged in the installation hole.

16. The dispensing device of claim 14, wherein the driving assembly comprises a driver and a rotating member secured to the door, and the driver rotates the rotating member to move the ring belt; the driven assembly further comprises a first positioning post and two second positioning posts; the ring belt surrounds the rotating member, the first positioning post, and the two second positioning posts; and the two second positioning posts are located between the first positioning post and the rotating member.

17. The dispensing device of claim 16, wherein the driver is secured to an outer surface of the door, and the driven assembly and the catching assembly is secured to an inner surface of the door.

18. The dispensing device of claim 14, wherein the ring belt is substantially an "L" shaped loop.

19. The dispensing device of claim 14, wherein the door defines a mounting hole, the rotating member comprises a head portion, a drive portion, and an installation portion; the drive portion is secured between the head portion and the installation portion; a cross-section of the drive portion is smaller than that of the head portion and greater than that of the installation portion; the head portion is engaged in the mounting hole through the ring belt, and the ring belt surrounds the drive portion.

* * * * *